US007347032B2

(12) United States Patent
Cirio

(10) Patent No.: US 7,347,032 B2
(45) Date of Patent: Mar. 25, 2008

(54) CAPPING HEAD FOR THE APPLICATION IN VACUUM CONDITIONS OF CAPS ON BOTTLES OR CONTAINERS IN GENERAL, A CAPPING MACHINE COMPRISING SAID HEAD, AND A METHOD FOR THE APPLICATION OF CAPS THAT CAN BE APPLIED BY MEANS OF SAID MACHINE

(75) Inventor: Sergio Cirio, Canelli (IT)

(73) Assignee: Arol SpA, Canelli (Asti) (IT)

( * ) Notice: Subject to any disclaimer, the term of this patent is extended or adjusted under 35 U.S.C. 154(b) by 0 days.

(21) Appl. No.: 10/799,888

(22) Filed: Mar. 15, 2004

(65) Prior Publication Data

US 2004/0187441 A1 Sep. 30, 2004

(30) Foreign Application Priority Data

Mar. 27, 2003 (IT) ..... TO03A0229

(51) Int. Cl.
*B65B 7/28* (2006.01)

(52) U.S. Cl. ..... 53/334; 53/331.5; 53/510; 53/427; 53/490

(58) Field of Classification Search ..... 53/334, 53/306, 331.5, 317, 353, 89, 510, 427, 490, 53/432

See application file for complete search history.

(56) References Cited

U.S. PATENT DOCUMENTS 3,255,568 A * 6/1966 Kretschmer, Jr. et al. ..... 53/95
3,350,839 A * 11/1967 Carter ..... 53/88
3,491,516 A * 1/1970 Bergeron ..... 53/317
3,537,231 A * 11/1970 Dimond ..... 53/201
3,775,944 A * 12/1973 Roberts ..... 53/334
3,895,478 A * 7/1975 Friendship ..... 53/77
4,086,747 A * 5/1978 Gorton et al. ..... 53/340
4,186,542 A * 2/1980 Oyagi ..... 53/88
4,232,500 A * 11/1980 Holstein ..... 53/334
4,729,204 A * 3/1988 Weiss ..... 53/88
4,848,419 A * 7/1989 Damen ..... 141/61
5,111,635 A * 5/1992 Neber ..... 53/334
5,419,094 A * 5/1995 Vander Bush et al. ..... 53/75
5,533,317 A * 7/1996 Galandrino ..... 53/334
5,758,469 A * 6/1998 George ..... 53/290
5,802,812 A * 9/1998 Heudecker ..... 53/431
5,884,450 A * 3/1999 Ronchi ..... 53/317
6,199,350 B1 * 3/2001 Brechel et al. ..... 53/510
6,230,472 B1 * 5/2001 Stahlecker ..... 53/426
6,341,472 B1 * 1/2002 Schroeder ..... 53/426
6,351,924 B1 * 3/2002 Gustafsson et al. ..... 53/425

* cited by examiner

*Primary Examiner*—Sameh H. Tawfik
(74) *Attorney, Agent, or Firm*—Sughrue Mion, PLLC

(57) ABSTRACT

Described herein is a capping head for the application of caps on bottles or containers, in which the capping head is enclosed within a casing having an end mouth that engages the bottle or the container during application of the cap so as to define a closed chamber, within which the capping head is contained. Said closed chamber is set in communication with a source of vacuum so as to empty the bottle or container of the air contained therein before completion of application of the cap.

1 Claim, 9 Drawing Sheets

CAPPING HEAD FOR THE APPLICATION IN VACUUM CONDITIONS OF CAPS ON BOTTLES OR CONTAINERS IN GENERAL, A CAPPING MACHINE COMPRISING SAID HEAD, AND A METHOD FOR THE APPLICATION OF CAPS THAT CAN BE APPLIED BY MEANS OF SAID MACHINE

BACKGROUND OF THE INVENTION

The present invention relates in general to equipment for applying caps on containers, and more particularly to equipment for the application of caps, for example aluminium caps, on the necks of bottles, via execution of an operation of rolling of the cap on the neck of the bottle.

It should, however, be considered that, even though the invention relates, in particular, to the equipment of the type referred to above, an application thereof to any other type of device for the application of caps on bottles or containers of any type is not ruled out either.

Capping equipment of the specific type mentioned above, which envisage capping heads each of which designed to carry out an operation of rolling on the cap during application thereof, has been known and used already for some time now. Equipment of this type is, for instance, illustrated in the U.S. Pat. No. 4,086, 747 and in the U.S. Pat. No. 4,232,500.

SUMMARY OF THE INVENTION

The purpose of the present invention is to provide a capping head and a capping machine of an improved type, which will enable the operation of application of the caps to be performed in a simple and reliable way, moreover guaranteeing additional advantages from the standpoint of an optimal preservation of the product within the bottle or container after the closing cap has been applied.

With a view to achieving said purpose, the subject of the present invention is a capping head for the application of caps on containers, in particular on the necks of bottles, characterized in that associated thereto is a casing having an end mouth designed to fit on the neck of the bottle or container so as to define a closed chamber inside the casing, within which the head is enclosed, and in that the capping head is moreover provided with means for connecting the aforesaid chamber with a source of vacuum, for the purpose of communicating said vacuum to the space inside the bottle or container before completion of application of the cap on the bottle or container.

A further subject of the invention is an apparatus for applying caps on containers or bottles of the type comprising at least one capping head and means for imparting a vertical movement and a rotation on said capping head, said apparatus being characterized in that each capping head is made in accordance with the present invention.

Finally, a further subject of the invention is a method of application of a cap on a container, which can be performed using the capping head described above.

Thanks to the characteristics referred to above, the capping head according to the invention is able, in addition to performing application of the cap according to what is already possible using capping heads according to the known art, also of creating a negative pressure in the space inside the container or bottle before completion of the application of the cap, so as to guarantee an optimal preservation of the product contained in the bottle or container after completion of the capping operation.

The preferred embodiment of the invention presents additional characteristics that are specified in the annexed claims, thanks to which the aforesaid result is achieved with relatively simple and reliable means.

BRIEF DESCRIPTION OF THE DRAWINGS

The invention will now be described with reference to the annexed drawings, which are provided purely by way of non-limiting example and in which.

DETAILED DESCRIPTION OF THE INVENTION

Figure 1A:
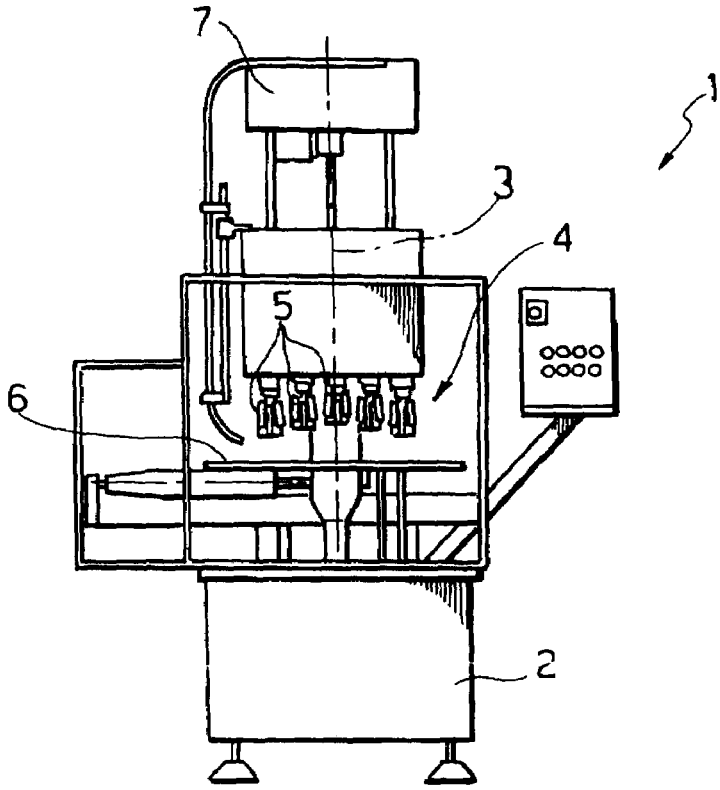
FIGS. 1A is a schematic elevational view, of a capping machine according to the known art, for the application of aluminum caps on the necks of bottles, by means of an operation of rolling.

In FIG. 1, the reference number 1 indicates as a whole a capping machine for applying aluminium caps on the necks of bottles. The machine 1 comprises a fixed supporting structure 2, on which there is mounted, so that it can rotate about a vertical axis 3, a carousel 4 of capping heads 5, designed so that each capping head applies an aluminium cap on a respective bottle. The bottles are designed to be carried by a platform 6, which also rotates about the axis 3 in synchronization with the carousel 4, in such a way that each bottle carried by the rotating platform 6, which moves along a circular path about the axis 3, is followed by a respective capping head 5, after receiving on its neck a cap that is to be applied coming from a reservoir or magazine of caps 7.

Figure 1B:
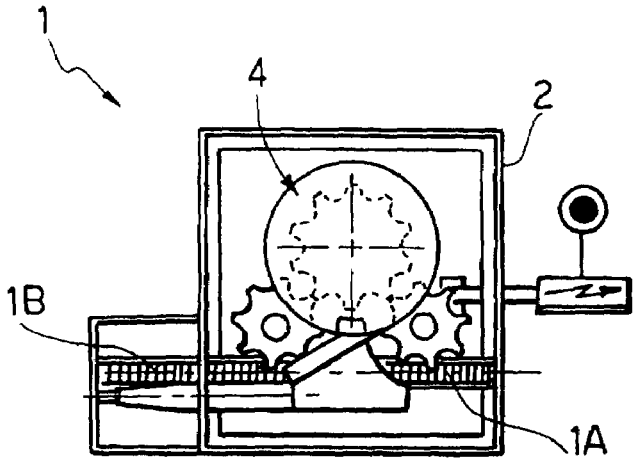
FIG. 1B is a plan view of the capping machine shown in FIG. 1A.

The bottles enter the carousel in succession, coming from an input line 1A and exit via an output line 1B (FIG. 1B).

During rotation of the carousel, each capping head 5 is lowered onto the bottle and performs a vertical movement accompanied by a respective rotation about its own axis, so as to carry out application of the cap.

Figure 2:
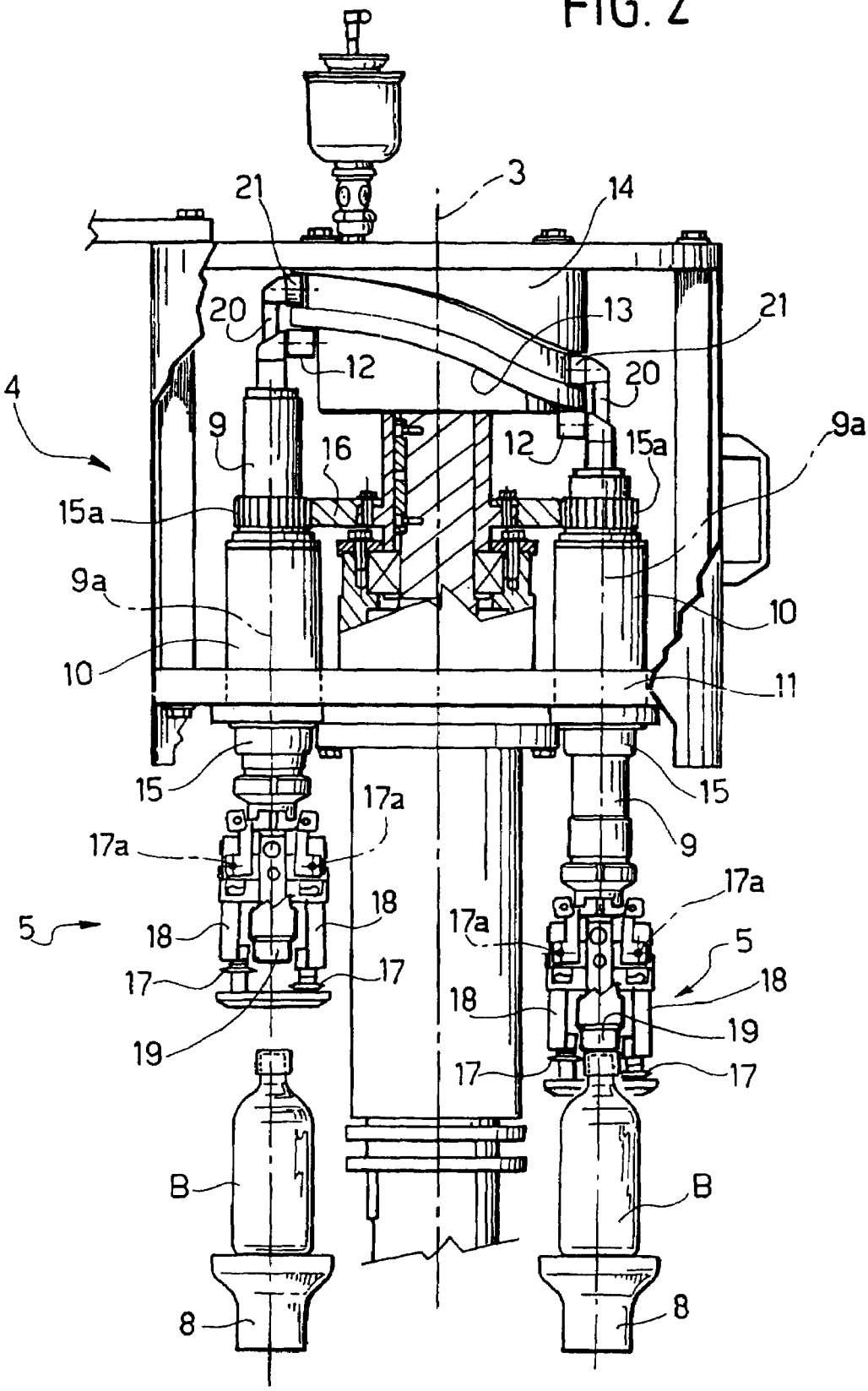
FIG. 2 is a partially sectioned view at an enlarged scale of a detail of the machine according to the known art illustrated in FIGS. 1A and 1B.

The structure and mode of operation of the capping head according to the known art are not illustrated in detail herein. FIG. 2 illustrates, however, at an enlarged scale two capping heads 5 forming part of the carousel of the machine built according to the known art. FIG. 2 illustrates also two bottles B set on two respective pedestals 8, carried by the platform 6, which rotates about the vertical axis 3 of the carousel. Each bottle B is surmounted by a capping head 5, which is mounted at the bottom end of a vertical stem 9, on which there is imparted a cyclical movement in a vertical direction and a rotation about its own axis 9*a* throughout the circular path followed by the capping head about the central vertical axis 3 of the carousel. The vertical movement of the stem 9 is guided within a respective bushing 10 rigidly connected to a wheel 11, which is controlled in rotation about the central axis 3. Said vertical movement is moreover controlled by the engagement of a cam-follower roller 12 and 21, connected to the top end of the stem 9, against a cam-like circumferential surface 13, formed on a central top body 14, which is rigidly connected to the fixed structure of the machine. The rotation of the stem 9 is, instead, obtained in so far as said stem slides within the bushing 10 with the interposition of a bushing 15, which is axially fixed with respect to the bushing 10, but is able to rotate within it. In turn, the stem 9 is axially slidable with respect to the bushing 15, but is connected in rotation therewith via a key fit (not visible in the drawing). The top end of the bushing 15 projects out of the top of the bushing 10 and carries a pinion 15*a*, which meshes with a gear wheel 16, connected to the fixed structure of the machine in such a way that the rotation of the disk 11 carrying the guide bushings 10 for guiding the various capping heads causes rolling of each pinion 15*a* on the gear wheel 16.

Each capping head 5 is provided with a plurality of rolling implements 17, in the form of wheels that are free to turn, each of which is carried by a rocker arm 18, which can rock about a horizontal axis 17*a* from a structure that rotates with the stem 9. In the final step of the operation of application of the cap, the top ends of the rocker arms 18 are actuated so as to displace the bottom ends, which carry the rolling implements 17 radially inwards. In this way the rolling implements 17, during the movement of vertical lowering and the simultaneous movement of rotation of the head 5 about the respective axis 9*a*, enter into engagement with the side surface of the respective cap and deform it so as to press it onto the neck of the bottle, copying the possible thread provided thereon. During said operation, the surface of the top end of the neck of the bottle is engaged by a mouth-pressing element 19, carried at the bottom end of an internal rod 20, which is mounted within the stem 9 with interposition of rolling bearings (not visible in FIG. 2). Said internal rod 20 enables the mouth-pressing element 19 not to follow the capping head in the rotation. At the top end there is provided a cam-follower roller 21, which engages a respective circumferential cam made in the block 14.

As already stated, the foregoing description relates to a capping head according to the known art.

FIGS. 3-7 illustrate, instead, a capping head according to the invention in five different steps of the its operation. In FIGS. 3-7, the parts corresponding to those of the capping head illustrated in FIG. 2 are designated by the same reference number.

Figure 3:
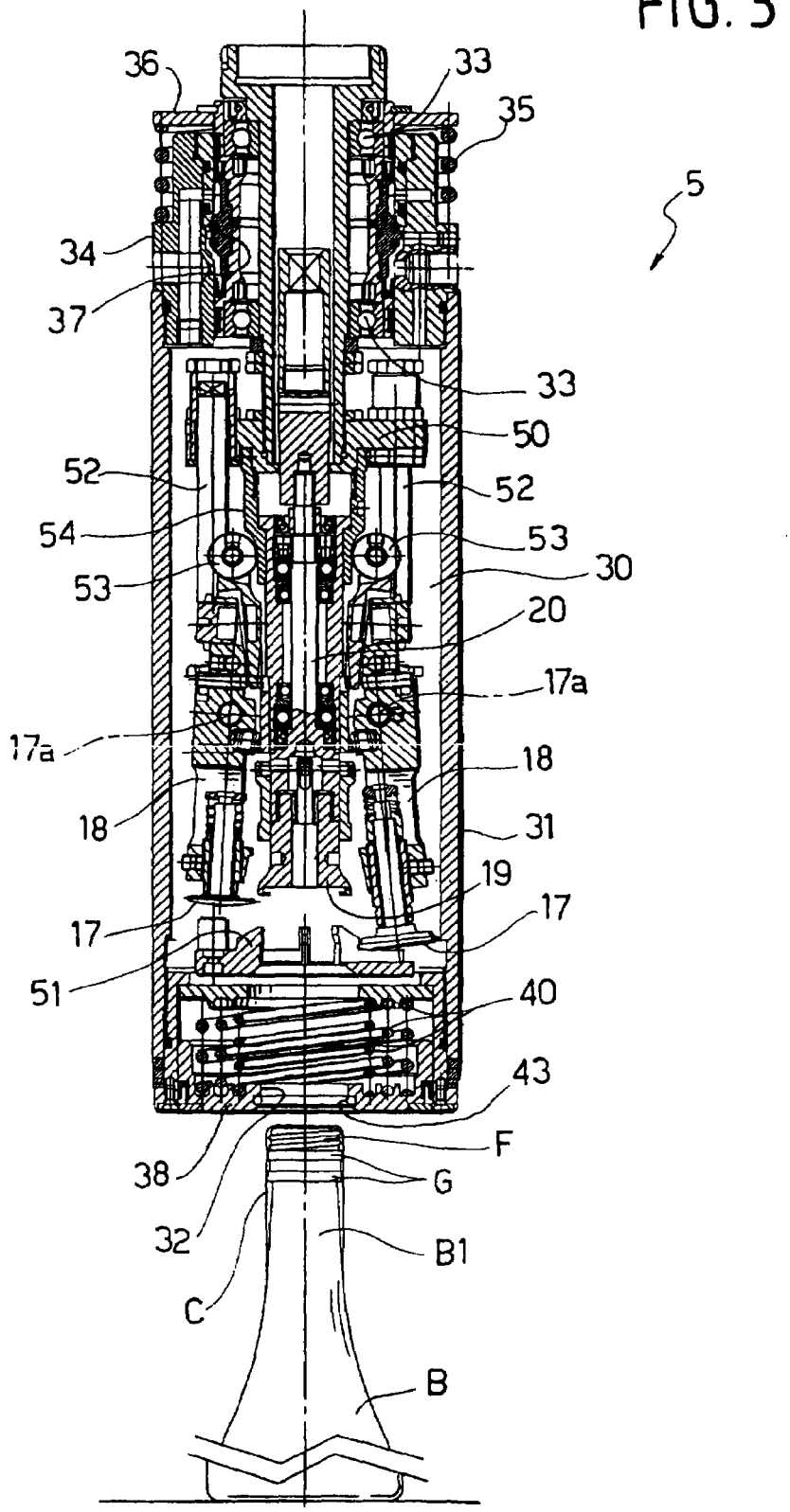
FIG. 3 is a cross sectional view of the capping machine according to the present invention in a first portion of its operation.

The main difference of the capping head 5, illustrated in FIGS. 3-7, with respect to the ones according to the known art lies in the fact that, in the case of the invention, the head 5 is enclosed in a chamber 30 defined by a tubular casing 31, which is associated to the bottom end of the stem 9 and has an bottom end mouth 32, designed to engage, in a fluid-tight way, the surface of the neck of the bottle B. FIG. 3 illustrates the capping head 5 still set at a distance from the bottle B, with the aluminium cap C positioned on the neck B1 of the bottle. As may be seen, the aluminium cap C has the shape of a drinking glass turned upside down, whilst the neck B1 of the bottle is shaped at its end with a thread F and circumferential collars G.

Figure 4A:
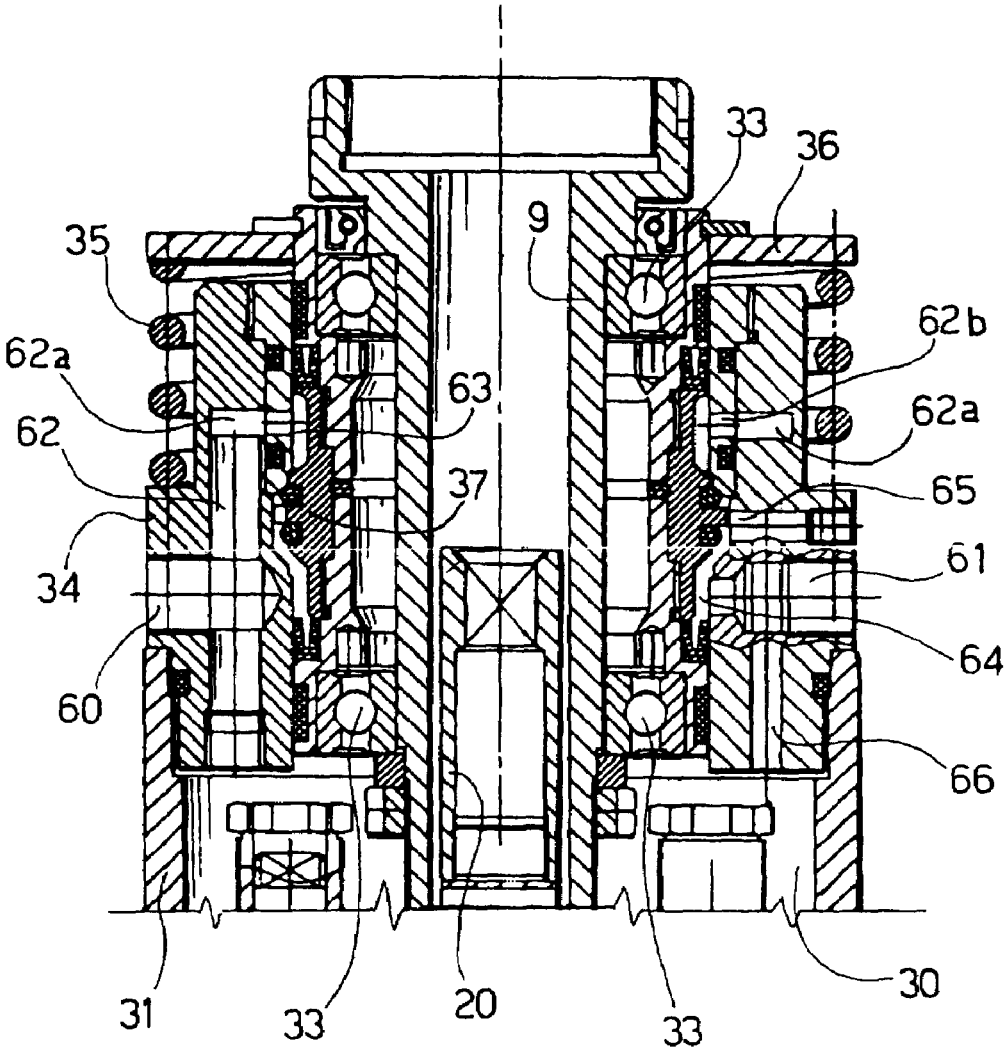
FIG. 4A illustrates on an enlarged scale a detailed of FIG. 4.
Figure 5:
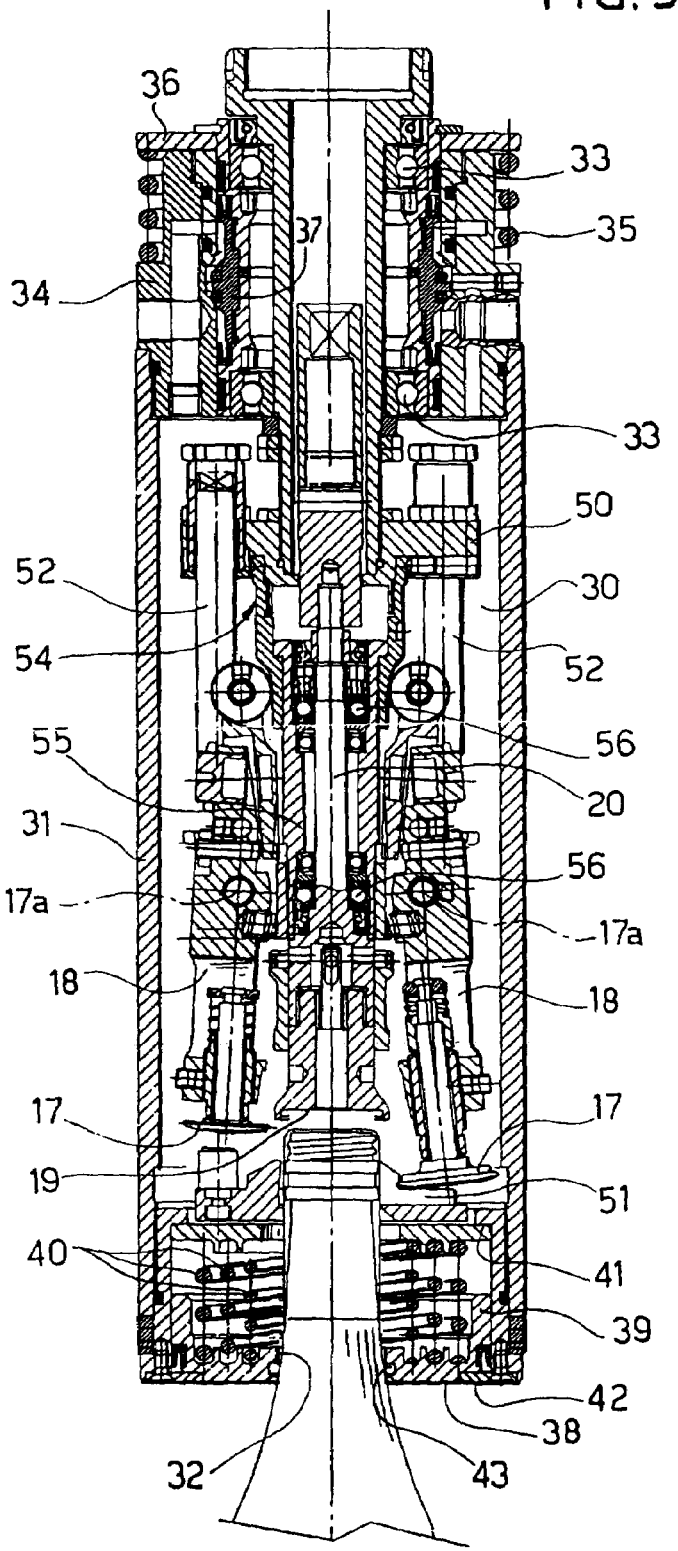
FIG. 5 is a cross sectional view of the capping machine according to the present invention in a third portion of its operation.
Figure 5A:
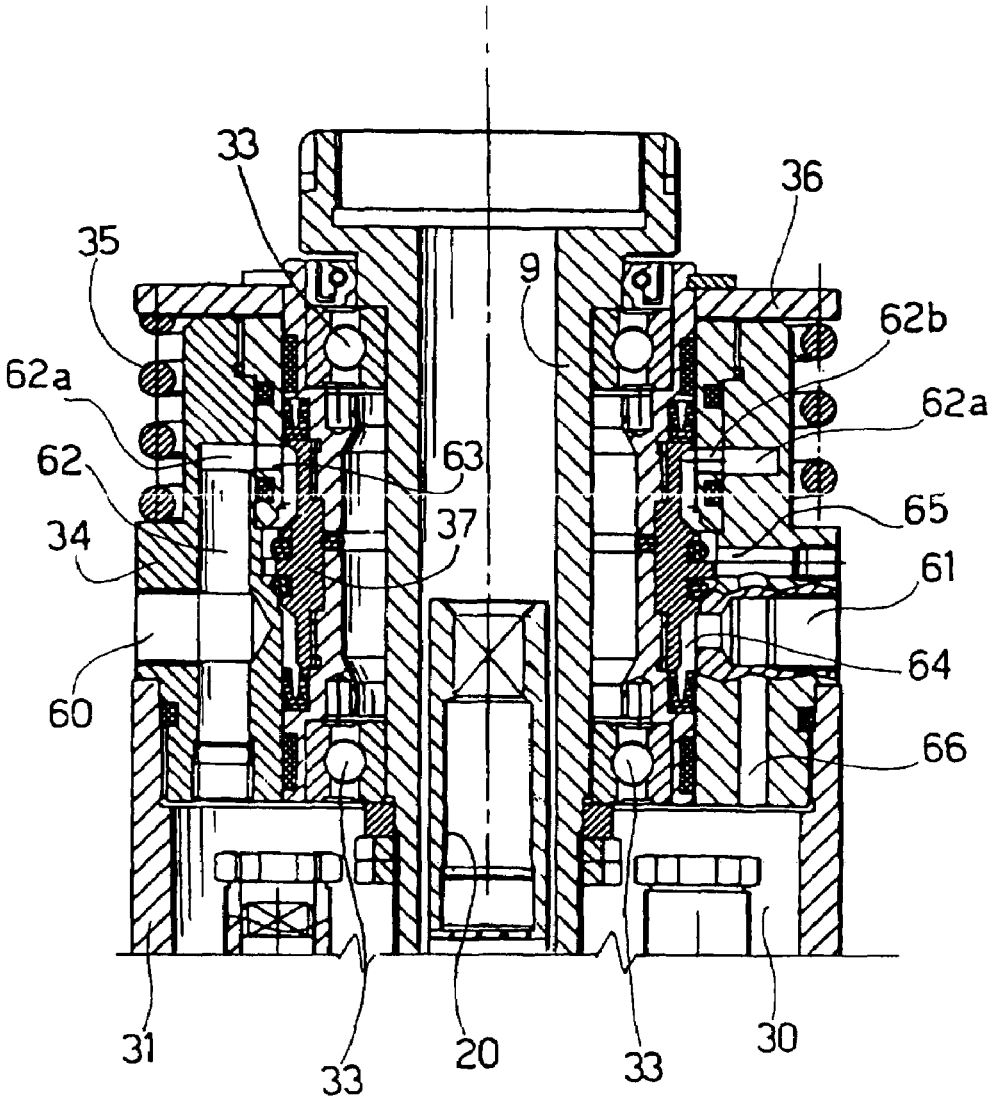
FIG. 5A cross sectional view of the capping machine according to the present invention in a third portion of its operation detail of FIG. 5.

The top end of the rigid casing 31 is associated, in the way that will be described in detail in what follows, to the stem 9, with the interposition of rolling bearings 33, which enable the casing 31 not to follow the stem 9 in rotation after the bottom end mouth 32 of the casing 31 has engaged the bottle B. More precisely, with reference to FIGS. 4A, 5A, the top end of the cylindrical skirt constituting the casing 31 is fixed to a valve body 34, the function of which will be illustrated in what follows. Said valve body 34 is in turn mounted with the possibility of a limited axial displacement on the stem 9. A helical spring 35 is set between an annular contrast made on the body 34 and a disk 36, which is fixed to the stem 9 with respect to its axial movements but does not follow, instead, the stem 9 in its rotation as a result of the interposition of the rolling bearings 33. Fixed to the disk 36 is a bushing 37 functioning as valve member, co-operating with the internal surface of the valve body 34 in the way that will be described in what follows.

As regards the bottom end of the casing 31, the end mouth 32 is made in a bottom wall 38 (see FIG. 4) of a glass-shaped member 39 slidably mounted within the bottom end of the casing 31, with three concentric helical springs 40 set between the bottom wall 38 and an internal annular contrast 41, defined in an element that is rigidly connected to the casing 31 so as to tend to keep the glass-shaped element 39 pushed against a flat arrest ring 42 secured to the bottom end of the casing 31. Mounted at the end mouth 32 is a seal ring 43.

Once again with reference to FIGS. 3-7, visible therein is just the bottom part of the control stem 9, the top part of which is designed to be rigidly connected to the portion illustrated. Once again in said figures, within the control stem 9 there is also illustrated the internal rod 20, which terminates, at its bottom end, with the mouth-pressing element 19 that is designed to engage the top surface of the bottle. Also in the case of the internal rod 20, the figures illustrate just the bottom portion of said rod, the top portion (not illustrated) being designed to be rigidly connected to the top end of the portion of the rod 20 that is visible in the drawings.

In a manner similar to that of the known machine, which has been described with reference to FIG. 2, associated to the control stem 9 is the moving element of the rolling implements 17. In accordance with the known art, each implement 17 consists of a disk mounted so that it can rotate at the bottom end of a rocker arm 18, which is supported in an oscillating way about an axis 17*a* by a structure fixed to the bushing 55. Said structure is connected to a plurality of columns 52, which can slide in the bushings fixed to the top head element 50, which is screwed to the control stem 9. At the bottom, starting from the structure fixed to the bushing 55 there are columns that connect it to the bottom head element 51. The top element 50 can drop with respect to the bushing 55 by means of the yielding of the springs (not visible in the drawing), which are set around the columns 52.

To return now to the casing 31, the valve assembly 34 connected to the top end of the latter (see FIG. 4) includes an outlet 60 for connection to a source of negative pressure, specifically a suction pump, and an outlet 61 for connection to a discharge.

The outlet 60 for connection to the source of negative pressure communicates, via an internal channel 62 made in the body 34, with an annular chamber 62*a* made in the body 34, which in turn communicates via radial holes 62*b* with an annular chamber 63, defined between the body 34 and the valve member 37. The outlet 61 for connection to the discharge communicates via a channel 61*a* made inside the body 34 with an annular chamber 63, defined between the valve body 34 and the valve element 37. Likewise, the outlet 61 for connection to the discharge communicates with an annular chamber 64, which is also set between the valve body 34 and the valve element 37. Finally, within the valve body 34 there is defined an annular chamber 65, which communicates, via a channel 66 made in the body 34, with the internal chamber 30 of the casing 31. The valve element 37 functions as a slide valve. This has two opposite conical surfaces provided with respective seal rings, which co-operate with corresponding conical surfaces made on the internal surface of the valve body 34. In a first end position of the valve element 37 with respect to the valve body 34, illustrated in FIG. 4A, the top conical surface of the valve element 37 is in contact with the respective conical surface of the valve body 34. In said condition, the annular chamber 63 is isolated with respect to the annular chamber 65, whilst the latter communicates with the annular chamber 64. Consequently, in said condition, the source of negative pressure is not in communication with the space inside the casing 31, whilst said space communicates with the discharge. In the opposite position of the valve element 37 (see FIG. 5A), the valve element 37 is in contact, with its bottom conical surface, against the respective conical surface of the valve body 34, so that the communication between the annular chamber 64 (connected to the discharge) and the annular chamber 65 (connected to the space inside the casing) is interrupted, and there is established, instead, a communication between the annular chamber 63 (connected to the source of negative pressure) and the annular chamber 65 (connected through the space inside the casing 31).

Operation of the capping head presented above is described in what follows.

Figure 4:
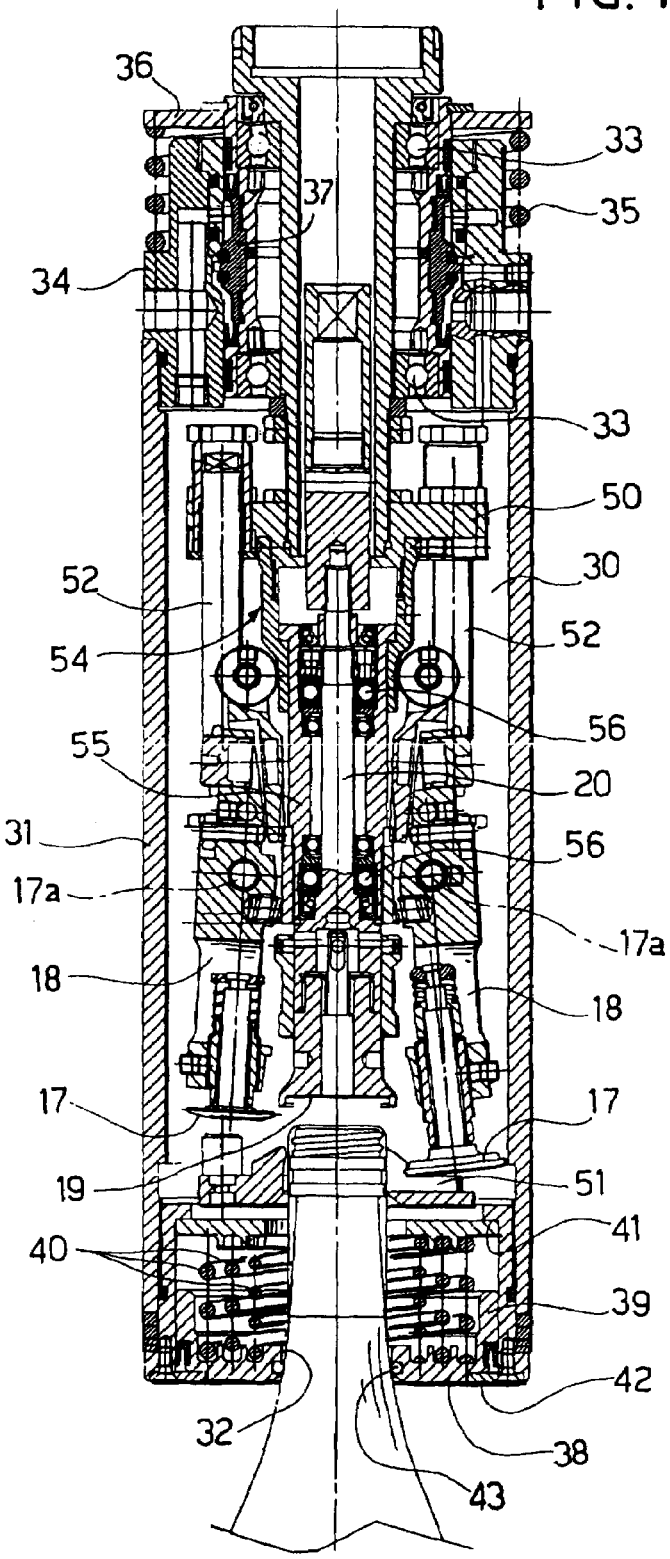
FIG. 4 is a cross sectional view of the capping machine according to the present invention in a second portion of its operation.

In the step illustrated in FIG. 3, the cap C is already positioned on the neck of the bottle B, and the capping head is still set at a distance therefrom. FIG. 4 illustrates the next step, in which the head 5 is lowered onto the neck of the bottle in such a way that the seal ring 43, provided on the bottom end mouth 32 of the casing 31, comes, for the first time, into contact with the surface of the bottle. In said condition, the top end of the neck of the bottle with the cap positioned thereon has entered the casing 31. Proceeding with the lowering of the capping head 5 (controlled by the stem 9, which in said step is moving downwards and rotating), first of all there is a compression of the top spring 35 until contact is made with the top disk 36, which is axially fixed to the control stem 9, and the valve body 34 (which cannot be displaced axially in so far as it is rigidly connected to the casing 31, which is in contact, at the bottom, against the neck of the bottle). Said small movement due to yielding of the helical spring 35 brings about displacement of the valve element 37 from the position illustrated in FIGS. 3, 4, 4A to the position illustrated in FIGS. 5, 5A. As already illustrated above, said displacement causes connection of the internal chamber 30 of the tubular casing 31 to the source of negative pressure and interruption of the connection of the chamber 30 to the discharge. It is important to note that, in said step, the cap C is not yet pressed onto the neck of the bottle, so that the air present inside the bottle is free to come out owing to the play existing between the cap and the neck, the air being suctioned by the source of negative pressure. The air contained inside the bottle first passes into the tubular casing 31, and from this reaches the outlet connection 60, passing through the channel 66, the annular chamber 65, the annular chamber 63, and the channels 62. As already illustrated above, the movement of the valve element has, of course, also caused interruption of the connection between the internal space of the tubular element and the outlet 61 for connection with the discharge.

Figure 6:
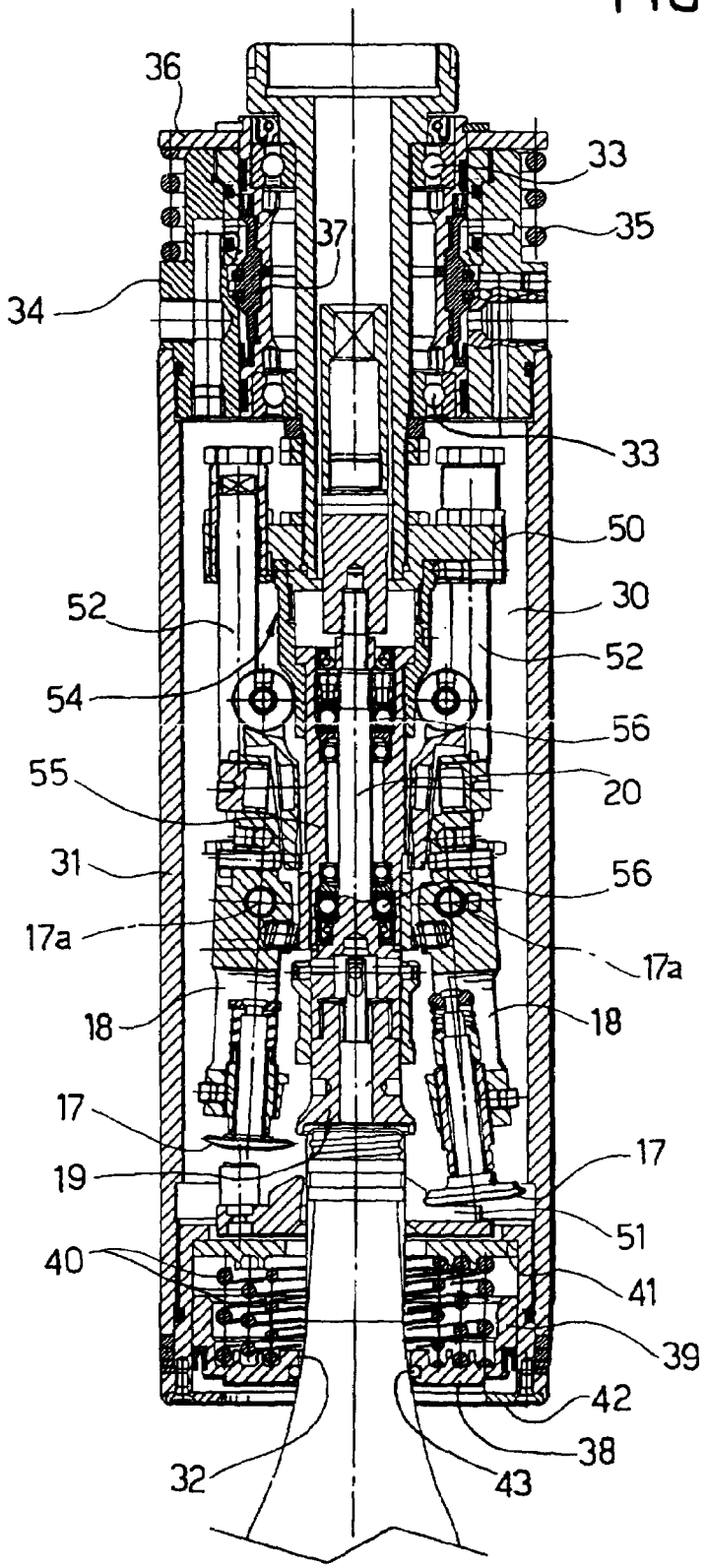
FIG. 6 is a cross sectional view of the capping machine according to the present invention in a further portion of its operation.

FIG. 6 illustrates the next step, in which the control stem 9 and the casing 31 have moved further down until the mouth-pressing element 19 is brought into the proximity of, but not into contact with, the top surface of the bottle. Said further movement comes about thanks to a compression of the helical springs 40, which enables the glass-shaped element 39 to move back into the tubular casing 31. The mouth-pressing element 19 is preferably provided with an annular lip made of deformable material for being fitted on the neck of the bottle. It is important to note that this first action of compression, exerted on the cap C and on the neck of the bottle, is applied when the negative pressure has been already applied to the inside of the bottle, so that the latter has been emptied of the air initially contained therein. Throughout the subsequent step of the operation, the negative pressure is maintained within the tubular casing 31.

Figure 7:
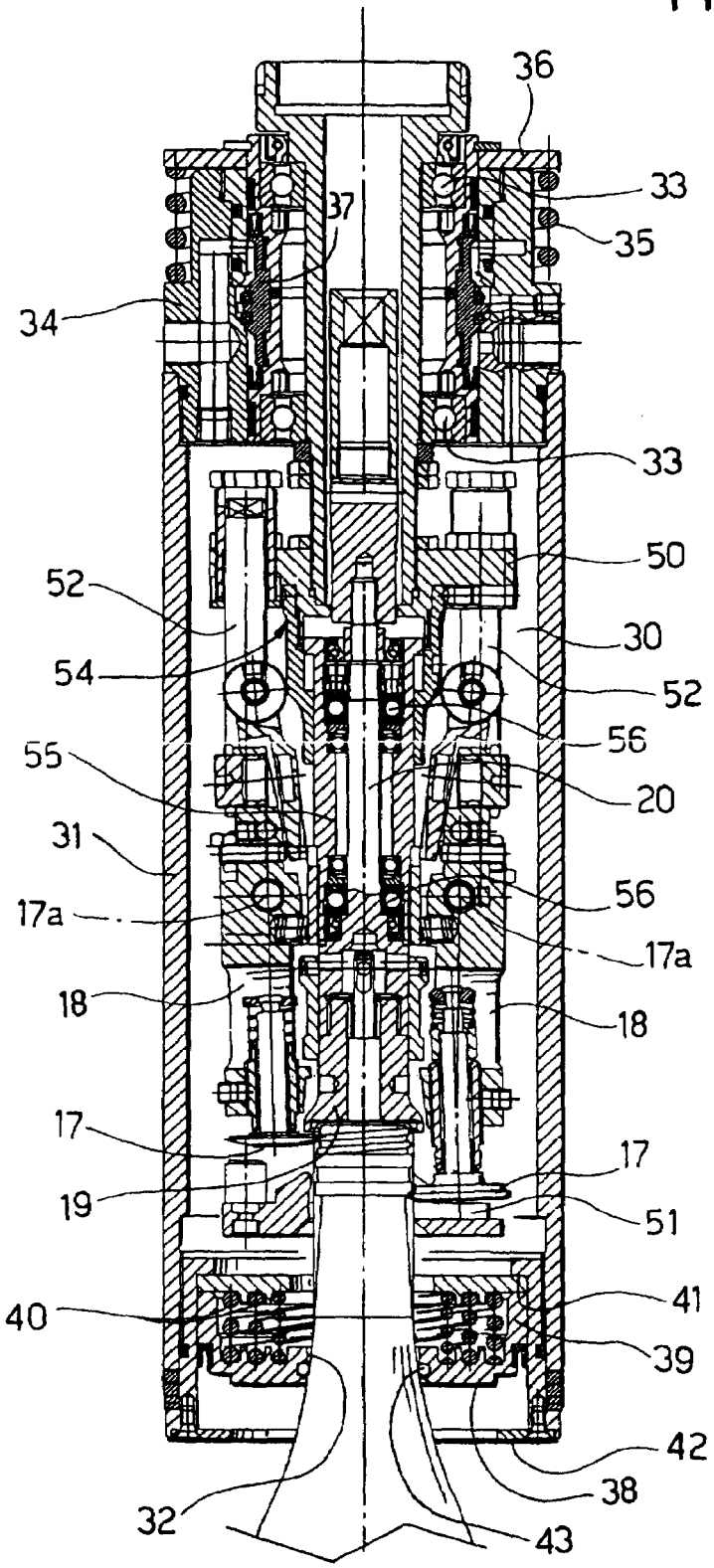
FIG. 7 is across sectional view of the capping machine according to the present invention in a fifth portion of its operation.

FIG. 7 illustrates the condition corresponding to a further lowering of the control stem 9. In said step, the internal rod 20 is no longer able to follow the control stem 9 as the latter is lowered, and the same applies to the bushing 55, which rotates with the control stem 9, which is axially fixed to the internal rod 20. There is consequently brought about a lowering of the cylindrical cam-like member 54 with respect to the bushing 55, which in turn brings about engagement of the rollers 53, carried at the top end of the rocker arms 18 on the portion of larger diameter of the tubular cam-like element 54. The rocker arms are thus forced to rotate, radially displacing the rolling implements 17 inwards. All this occurs whilst the control stem 9 continues to rotate, so that the rolling implements 17 perform an operation of rolling of the cap C onto the bottle, which bestows the corresponding shape on the cap, with a thread and collars corresponding to the thread F and to the collars G of the neck of the bottle.

Once application of the cap is completed, the assembly moves back upwards, repeating in reverse order the movements described above. In the last step, the helical spring 35 is re-distended, thus bringing the valve element 37 back into the initial condition illustrated in FIG. 3, so as to re-establish communication between the internal chamber 30 of the casing 31 and the discharge. The space inside the casing consequently returns to atmospheric pressure, guaranteeing easy release of the bottle from the device since the space inside the bottle is under negative pressure.

As emerges clearly from the foregoing description, the main characteristic of the capping head according to the invention lies in the fact that it is enclosed within a casing 31, which defines a closed chamber that is connected with a source of vacuum during the operation of application of the cap. In this way, the air contained inside the bottle is sucked out of the bottle before the cap is definitively pressed onto the bottle. From the foregoing description it moreover emerges clearly that in the case of the preferred embodiment the structure of the capping head also includes the valve means, which enable connection of the space inside the casing with the source of vacuum to be made automatically during application of the cap. However, it would be altogether possible to envisage means of any other different type, which might even be altogether extraneous to the structure of the capping head, designed to activate suction of air out of the bottle in the step of application of the cap. In addition, even though the present invention has been illustrated with reference to a capping head of the type designed to carry out rolling of the cap, it is in theory possible to apply the invention to any type of device for application of caps, tops or closing elements on bottles or containers of any type.

Furthermore, without prejudice to the principle of the invention, the details of construction and the embodiments may vary widely with respect to what is described and illustrated herein purely by way of example, without thereby departing from the scope of the present invention.

What is claimed is:

1. A capping head device for application of a cap to a container, comprising:

a casing having an end mouth designed to fit on the container so as to define a closed chamber;

a capping head disposed within said chamber, said capping head directly contacting the caps so as to apply the cap to the container; and means for connecting said closed chamber with a source of vacuum for the purpose of communicating said vacuum to the space inside the container before the end of application of the cap on the container, said connecting means being configured to control fluid communication between said closed chamber and said source of vacuum in direct dependence on the relative axial position of said casing with respect to said capping head, wherein said casing is mounted on said capping head so as to be movable therewith towards and away from the container, and that said closed chamber is defined by said casing when the casing engages the container as a result of the lowering movement of the capping head onto the container, wherein said casing is mounted on the structure of the capping head with interposition of rolling bearings and has its end mouth made in an end wall that is elastically compliant within the casing, and wherein said connection means comprise valve means set between the structure of the casing and the structure of the capping head, said valve means comprising a valve body rigidly connected to the casing and mounted to be axially slidable with respect to a valve element, said valve element being mounted with interposition of the aforesaid rolling bearings on the structure of the capping head.

* * * * *